US005667425A

United States Patent [19]

Pineau et al.

[11] Patent Number: 5,667,425

[45] Date of Patent: Sep. 16, 1997

[54] DEVICE FOR CENTERING AND CLAMPING A COMPONENT WITH A VIEW TO LAPPING IT USING AN EXPANSION LAP

[75] Inventors: Jean Claude Pineau, Chailly en Biè; Richard Bonachera, Vincennes, both of France

[73] Assignee: Societe Procedes Machines Speciales S.P.M.S., Evry Cedex, France

[21] Appl. No.: 393,537

[22] Filed: Feb. 23, 1995

[30] Foreign Application Priority Data

Feb. 28, 1994 [FR] France ..... 94 02256

[51] Int. Cl.[6] ..... B24B 19/11; B24B 1/00; B24B 51/00

[52] U.S. Cl. ..... 451/27; 451/51; 451/61; 451/124; 451/381

[58] Field of Search ..... 409/143; 451/5, 451/11, 27, 51, 124, 61, 180, 381, 900

[56] References Cited

U.S. PATENT DOCUMENTS

| | | | |
|---|---|---|---|
| 1,762,810 | 6/1930 | Brittain, Jr. et al. | 451/27 |
| 1,778,675 | 10/1930 | Kempton et al. | 451/27 |
| 2,535,199 | 12/1950 | Day | 451/381 X |
| 3,029,562 | 4/1962 | Kroen . | |
| 3,552,069 | 1/1971 | Butler . | |
| 3,557,492 | 1/1971 | Greenberg | 451/381 X |
| 3,874,121 | 4/1975 | Kikuchi et al. | 451/27 X |

FOREIGN PATENT DOCUMENTS

| | | |
|---|---|---|
| 2508366 | 12/1982 | France . |
| 2541613 | 8/1984 | France . |
| 2903622 | 8/1980 | Germany . |

*Primary Examiner*—Timothy V. Eley

*Attorney, Agent, or Firm*—Beveridge, DeGrandi, Weilacher & Young, LLP

[57] ABSTRACT

Device for centering and clamping a component (1) with a view to lapping it, comprising a rest (10) for applying the component (1) against a fixed stop (3), a first piston (7) with a long stroke and a second piston (8) with a short stroke interposed between the rest (10) and the first piston (7), anti-rotation means (18) for the component (1), a blocking element (12) for blocking the first piston (7) relative to its cylinder (6), as desired, and controls for, in succession, a)—advancing the two pistons (7, 8) in order to clamp the component (1), b)—blocking the first piston (7) relative to its cylinder (6) using the blocking element (12), c)—retracting the second piston (8) in order to unclamp the component (1), d)—introducing the lap (4) into the component (1) immobilized by the anti-rotation means (18) and, driving it in rotation, expanding the lap (4) until a pre-determined torque is established between the lap (4) and the component (1) and e)—advancing the second piston (8) in order to reclamp the centered component (1).

7 Claims, 4 Drawing Sheets

DEVICE FOR CENTERING AND CLAMPING A COMPONENT WITH A VIEW TO LAPPING IT USING AN EXPANSION LAP

BACKGROUND OF THE INVENTION

For lapping components such as the gears of gearboxes, it is known to place the gears with a slight axial clearance into cassettes which are held by a cardan-type suspension device during lapping, with an antirotation device being provided for preventing the gear from rotating under the effect of the lap. The main drawbacks of this method of lapping are that it is necessary to place each gear to be lapped in a suitably designed cassette, that the cassette and its suspension have many components susceptible to wear, that the antirotation device which angularly immobilizes the gear while it is being lapped has to be sized as a consequence of the torque transmitted therefrom and that in the case of gears in which the reference faces are set back, the faces via which the gear contacts the cassette do not coincide with its reference faces.

Another known centering and clamping device specially designed for lapping gears comprises a fixed stop against which the gear to be lapped is applied directly by a rest on which a set of concentric fluid pistons acts. This set comprises a first fluid piston with a large stroke relative to its cylinder, and a second fluid piston interposed between the rest and the first piston and having a short stroke relative to the latter. The stroke of the first piston is fixed and selected so that when the first piston is fully extended and second piston is fully retracted, a slight amount of play less than the stroke of the second piston remains between the gear and the rest and/or the fixed stop. With the gear thus angularly immobilized by an anti-rotation system, the lap, driven in rotation, is then engaged inside the gear and the lap is expanded until a predetermined braking torque is established between the lap and the gear, indicating that the abrasive stones of the lap are in contact with the bore of the gear, and the latter is then centered relative to the lap. The second piston is then extended so that the gear thus centered is clamped by bearing against the fixed stop, with a view to its being lapped.

This known device, while offering advantages relative to the cassette device (fewer wearing components, the possibility of making the gear/rest and gear/stop contact surfaces coincide with reference surfaces which are set back on the gear) does however exhibit the drawback that the stroke of the first piston is fixed and predetermined, so that on each change from a gear having a given axial thickness to a gear having a different axial thickness it is necessary also to change the stop to replace it with a stop having a complementary axial size.

SUMMARY OF THE INVENTION

The present invention is a device for centering and clamping a component with a view to lapping it using an expansion lap, which device, while being of simple structure, can be used without modification for lapping components having different axial thicknesses.

The subject of the invention is a device for centering and clamping a component, especially a gear, with a view to lapping it using an expansion lap, comprising a rest via which the component to be lapped is applied against a fixed stop, and a set of two concentric fluid pistons acting on the rest. The two pistons include a first fluid piston with a long stroke and a second fluid piston with a short stroke interposed between the rest and the first piston. Further, the present invention also includes a means for angularly immobilizing the component to be lapped. According to the invention, the device further comprises a blocking element for blocking the first piston in its position relative to its cylinder, as desired. The device moreover comprises suitable controls for, in succession, a) feeding the two pistons with fluid so as to clamp the component against the stop, b) blocking the first piston in its position relative to the cylinder with the aid of the blocking element, c) reversing the feed of the second piston in order to retract the end of the piston, and thus unclamp the component, d) introducing the lap into the component angularly immobilized by the anti-rotation means and, driving it in rotation, expanding the lap until a predetermined torque is established between the lap and the component which is thus centered, and e) again reversing the feed of the second piston so as to bring it back to the end of its travel in the extended position and reclamp the component against the stop.

In the device in accordance with the invention, the first piston therefore has a stroke which is independent of the axial thickness of the component to be lapped, so that the device can be used without preference for clamping components with different axial thicknesses. The first piston covers a forward stroke which is automatically adapted to the axial thickness of the component to be lapped and is then blocked in position until lapping is finished. The second piston covers a predetermined fixed stroke which is independent of the axial thickness of the component to be lapped.

In order that, following the clamping after the component has been centered, the thrust exerted by the lap on the component does not have to be withstood by the element for blocking the first piston, it is possible, following the step (e), to f) feed the first piston with fluid to extend it forward and eliminate the blocking of the first piston by its blocking element until the operation of lapping the component has finished.

Preferably, the second piston will be supplied by fluid in the retraction process according to the step c) via the first piston, in which case the step c) also comprises the feeding of the first piston with fluid in the retraction process.

Although other blocking elements may be used for blocking the first piston in its cylinder, it is advantageous for this blocking element to consist of a fluid chuck, of a type known in the art.

BRIEF DESCRIPTION OF THE DRAWINGS

With reference to the appended diagramatic drawings, one illustrative and non-limiting embodiment of a device in accordance with the invention will be described in more detail hereinbelow, in which.

DETAILED DESCRIPTION OF THE DRAWINGS

Figure 1:
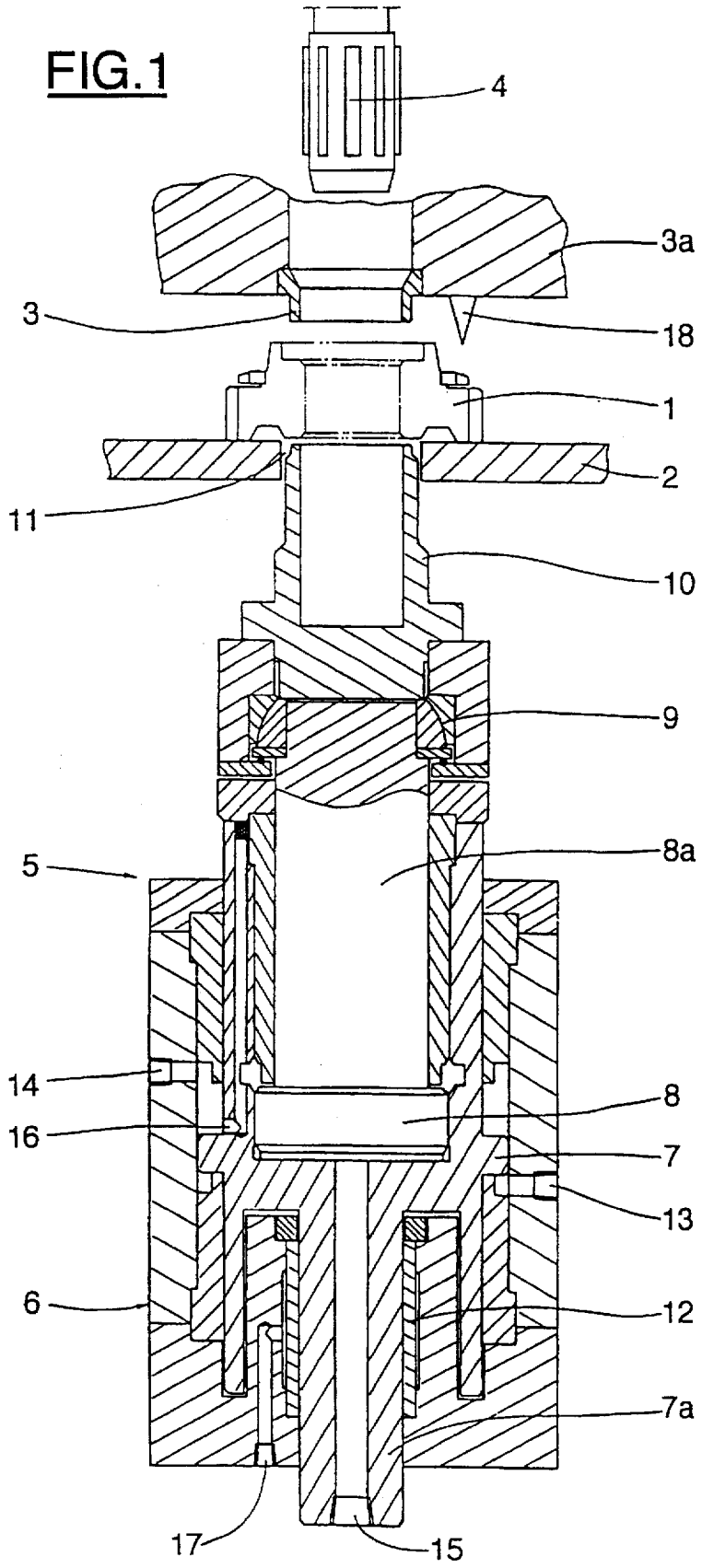
FIG.1 is a section of a centering and clamping device in accordance with the invention, in the rested position.

According to FIGS. 1 and 2, a gear 1, the bore of which is to be lapped, is conveyed by a means (which is not illustrated) onto a support surface 2 which is located below a stop 3 installed in a fixed position a distance above the support surface 2 on a support 3*a*. The support 3*a* and the stop 3 have a hole passing through them for introducing an expansion lap 4 into the bore of the gear 1 from above.

Below the surface 2 there is installed a device 5 for centering and clamping the gear 1 on the stop 3 when in a clamped state. This device comprises a cylinder 6 in which a first piston 7 can move vertically to and fro, this first piston 7 itself acting as a guide for a second piston 8 extended upwards by a rod 8*a* which, via a swivel joint 9, supports a rest 10 for the gear 1. The rest 10, which is hollowed out in its upper part providing clearence for the lower end of the lap 4, under the action of the two pistons 7 and 8 and within a hole 11 in the support surface 2, raises the gear 1 and clamps it against the stop 3.

A fluid chuck 12 is fixed in the cylinder 6 around a rod 7*a* which is the lowest portion of the piston 7, extending beyond the cylinder 6.

The first piston 7 can be fed with pressurized fluid, on its lower face via a connector 13, in order to advance the first piston 7 forward. Pressurized fluid is released from the first piston 7 through its upper face via a connector 14 on the cylinder 6 when retraction of first piston 7 is desired. The second piston 8 can be fed with pressurized fluid on its lower face by a connection 15 provided on the rod 7*a* to advance the second piston 8 and release fluid through its upper face by a passage 16 formed in the piston 7 and communicating with the connector 14 for feeding the latter when retraction is desired.

The chuck 12 can be fed with fluid by a connector 17 on the cylinder 6.

Support 3*a* bears a finger 18 projecting downward in order to serve as anti-rotational element for the gear 1, which is described in more detail hereinbelow.

Figure 2:
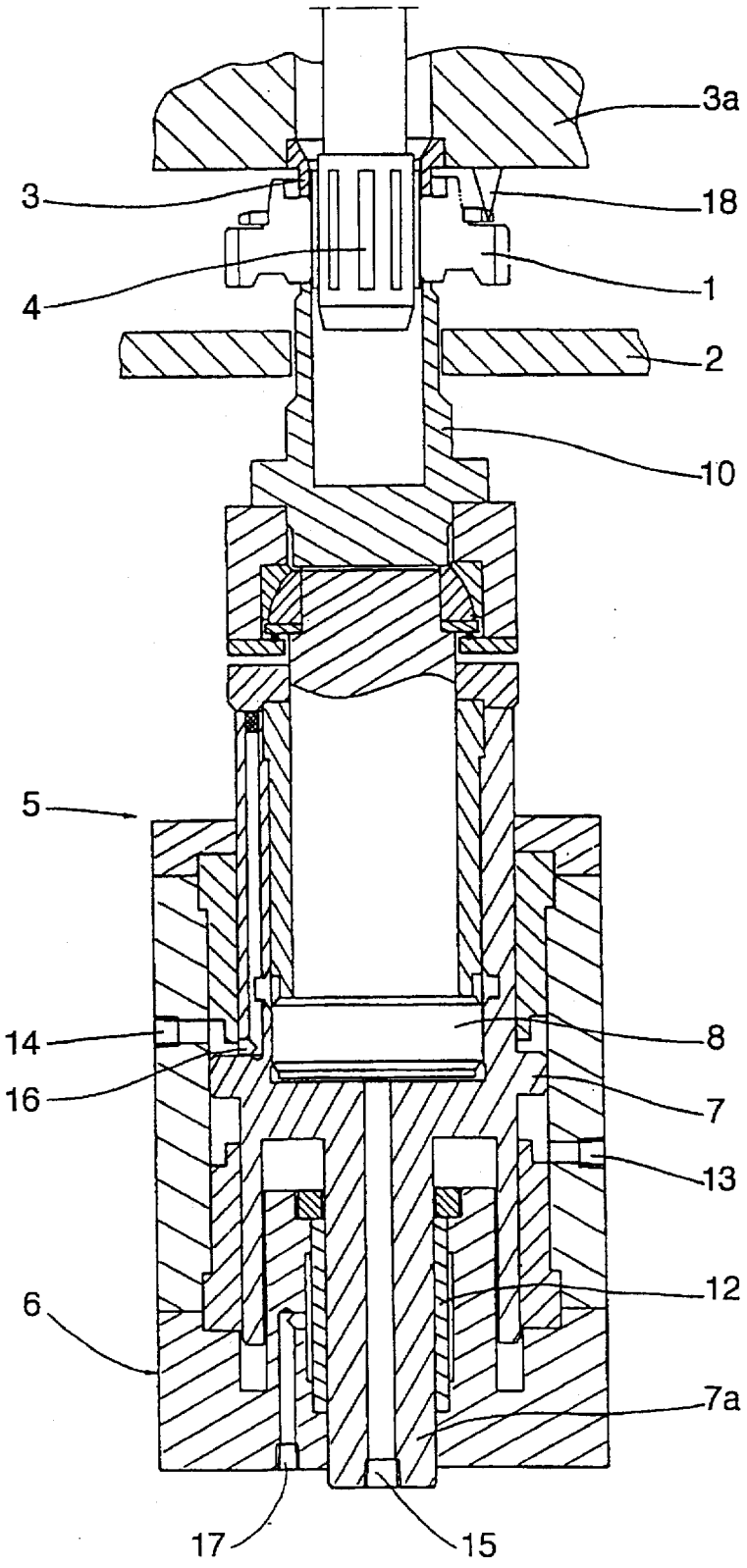
FIG. 2 is a section of the device of FIG. 1 in the centering position.

In FIG. 1, the device 5 is represented in the rested position, the two pistons 7 and 8 being in the retracted position (bottom position) and the chuck 12 being loose.

In order to clamp the gear 1 against the stop 3 and center it on the stop 3, and thus also centering the gear 1 on the lap 4, which is to lap the bore of the gear 1 by passing through the stop 3, the various fluid elements of the device 5 are fed, by controls, in the way described hereinbelow.

Firstly, the connectors 13 and 15 are fed with pressurized fluid in order to advance the two pistons 7 and 8 upward. Preferably, the piston 8 advances to the full extent of its travel and the piston 7 then advances until the gear 1 has been clamped against the stop 3 by the rest 10. In this position, the finger 18 of the support 3*a* of the stop 3 automatically comes into engagement with the teeth of the gear 1 and prevents the latter from rotating.

Secondly, the chuck 12 is fed with pressurized fluid by its connector 17, so that the chuck 12 secures the rod 7*a* of the piston 8 in its position relative to the cylinder 6.

Thirdly, the feed of the first piston 7 and of the second piston 8 with pressurized fluid is reversed, depressurizing the connector 15 and pressurizing the connector 14 and, consequently, the passage 16 which communicates with the connector 14. The first piston 7, blocked by the chuck 12 does not change position, while the second piston 8 is thus retracted downward. In this way, the rest 10 descends by the length of the stroke of the second piston 8 and thus unclamps the gear 1, while keeping it in engagement with the finger 18. The device is illustrated in this state in FIG. 2.

Fourthly, the expansion lap 4 is introduced into the bore of the gear 1 from above through the support 3*a* and the stop 3 and, while driving the lap in rotation, the latter is expanded so that its lapping stones come into contact with the bore of the gear 1 to be lapped. This expansion continues until a predetermined torque is measured, by a torque detector, between the lap 4 and the gear 1 angularly immobilized by the finger 18. Detection of this torque is the sign that the gear 1 is perfectly centered on the lap.

Fifthly, the feed of the second piston 8 is reversed again by pressurizing its connector 15, so that the piston 8 is again advanced to the end of its stroke and reclamps the gear 1 previously centered by the lap 4 against the stop 3.

The actual lapping of the gear 1 can then be carried out by the lap 4, the device 5 remaining in the same position.

However, in order to prevent the chuck 12 from having to withstand the thrust which the lap 4 exerts on the gear 1 during lapping, it is possible, when the gear 1 is centered and clamped and before proceeding with the actual lapping, to advance the first piston 7 upward by feeding pressurized fluid via the connector 13. The feeding of the chuck 12 via the connector 17 is then eliminated, so that the chuck 12 unblocks the rod 7*a* and the piston 7, the gear 1 then being held clamped against the stop 3 by the piston 7 and the piston 8 rather than by the chuck 12.

The stroke of the second piston 8 may be very short (of the order of 0.5 mm) since this piston has the sole function of allowing the gear 1 to become unclamped, after initial clamping, to have it centered by the lap 4 and, then, of reclamping the gear 1 after it has been centered by the lap 4.

The first piston 7 must, however, have a sufficient stroke to allow all gears 1 to be lapped to be clamped against the same fixed stop 3. That is to say the first piston 7 must compensate for any differences in axial thickness that these gears 1 may exhibit.

It should be noted that the anti-rotation finger 18 is a fixed component, i.e. not controlled, and that it is not stressed during actual lapping because the gear is angularly immobilized by it being clamped against the stop 3.

Figure 3:
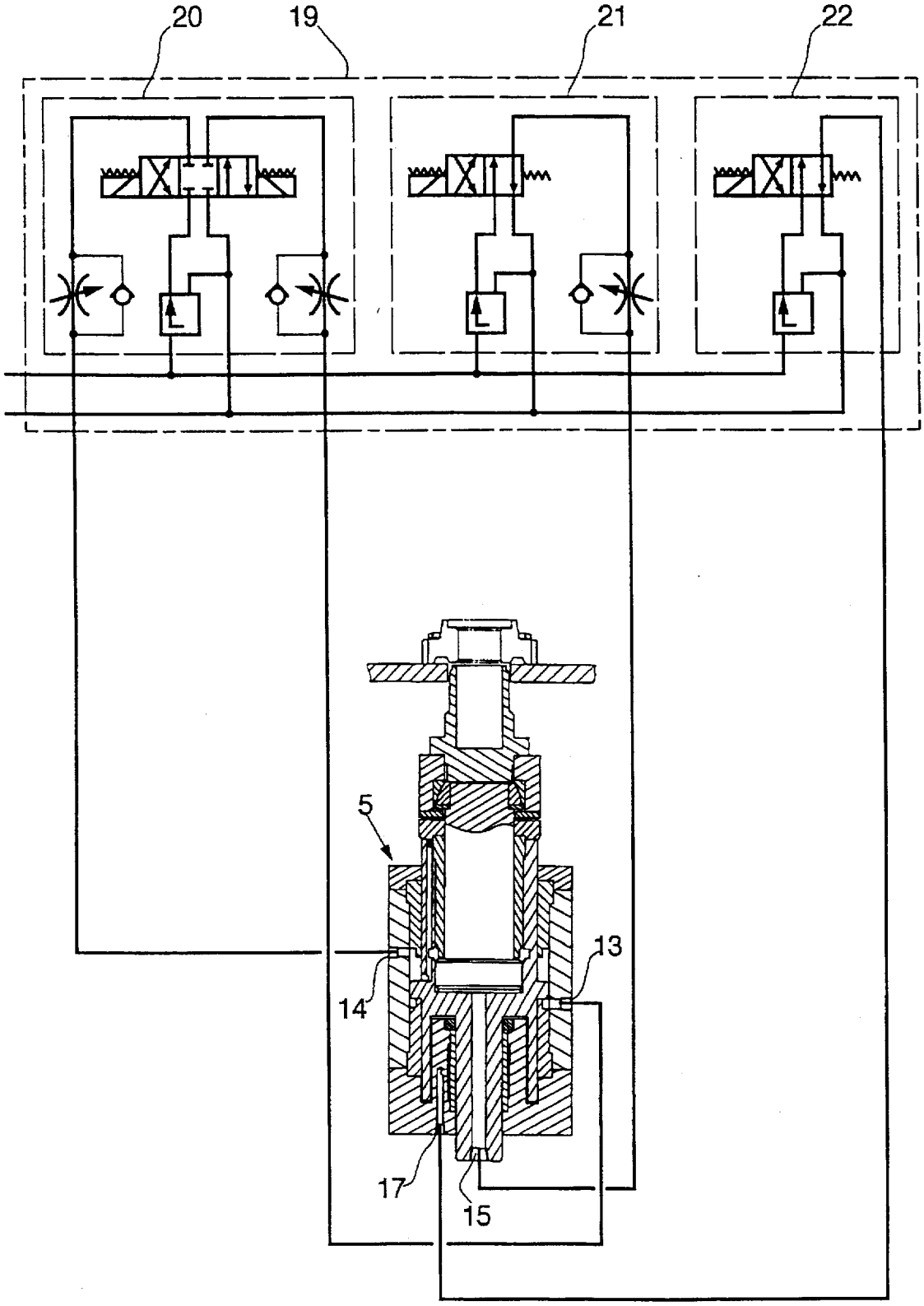
FIG. 3 represents a diagram of the hydraulic controls of the device of FIGS. 1 and 2.

According to FIG. 3, the hydraulic controls 19 of the device 5 comprise three subassemblies 20, 21 and 22. The subassembly 20 for advancing/retracting the piston 7, connected to the connectors 13 and 14, controls the advancement and retraction of the piston 7 (and the retraction of the piston 8 after fluid exits through passage 16) and comprises a 4/3 electric directional-control valve (four orifices, three positions), a pressure regulator and two flow limiters (nonreturn valve with restrictions). The subassembly 21 for advancement of the piston 8, connected to the connector 15, controls the advancement of the piston 8 and comprises a 4/2 electric directional-control valve (four orifices, one of which is plugged, two positions), a pressure regulator and a flow limiter. The subassembly 22 for blocking the piston 7, connected to the connector 17, controls the clamping/loosening of the chuck 12 and comprises a 3/2 electric directional-control valve and its pressure regulator.

Figure 4:
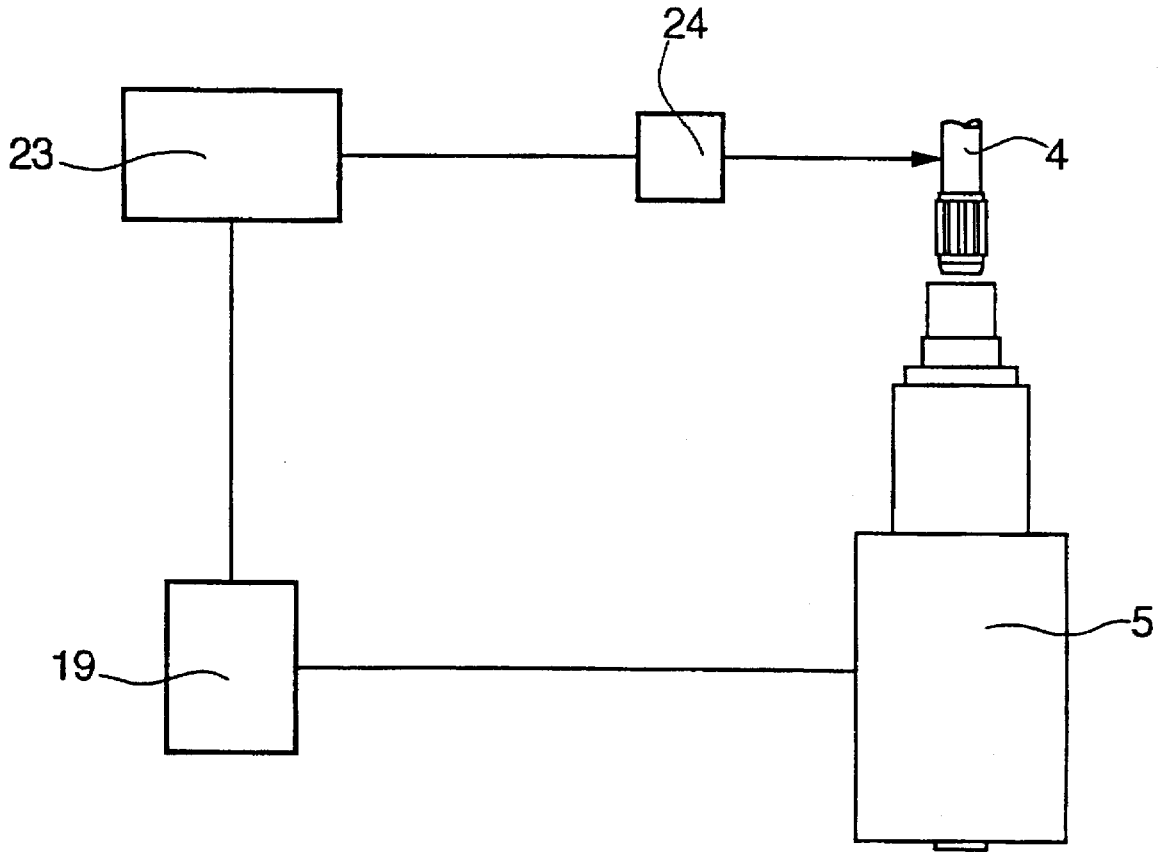
FIG. 4 represents a block diagram of the control system.

According to FIG. 4, the hydraulic controls 19 of the device 5 are supplemented by electronic controls 23 which control the progress of the sequences as described hereinabove, by causing a torque measurement to be made on the lap 4 (detector element 24) for defining the end of the cycle of centering the gear 1. This torque measurement may be taken, for example, by measuring the current consumed by the electric motor for driving the lap, or in any other way known or conventional within the art.

There are grounds for noting that, within the context of the invention, the retraction of the piston 7, instead of being done by fluid (connector 14 and passage 16) could equally be brought about by a return spring.

We claim:

1. A method of lapping workpieces of varying axial thicknesses with an expansion lap using a device having a fluid cylinder, a first piston mounted in said fluid cylinder having a first stroke including a first advanced position, a first retracted position and an intermediate position, first advancing means communicating with said first piston for advancing said first piston, a second piston concentrically mounted in said first piston having a second stroke including a second advanced position and a second retracted position and said second stroke being substantially shorter than said first stroke, second advancing means communicating with said second piston for advancing said second piston, a fixed stop, a workpiece rest for supporting a workpiece and positioned between said workpiece and said second cylinder, anti-rotation means in contact with said fixed stop for preventing angular movement of said workpiece, retraction means communicating with said first and said second pistons for retracting said first and said second pistons, blocking means for supporting said first piston when said retracting means is retracting said second piston into said position other than said second advanced position, and means for controlling said first advancing means, said second advancing means and said blocking means, the method comprising:

clamping said workpiece between said fixed stop and said workpiece rest by advancing said first piston to said intermediate position and advancing said second position to said second advanced position;

blocking said first piston relative to said fluid cylinder with said blocking means;

unclamping said workpiece by retracting said second piston to a position other than said second advanced position;

engaging said anti-rotation means with said workpiece to prevent angular movement of said workpiece;

centering said workpiece relative to said expansion lap; and reclamping said workpiece, now centered relative to said expansion lap, between said fixed stop and said workpiece rest by advancing said second piston to said second advanced position.

2. A method for lapping workpieces of varying axial thicknesses as in claim 1, wherein said step of centering said workpiece includes:

introducing said expansion lap into an orifice in said workpiece;

driving said expansion lap in rotation;

expanding said expansion lap; and sensing a predetermined torque indicative of a centered workpiece.

3. A method for lapping workpieces of varying axial thickness as in claim 1, further including after the step of reclamping the centered workpiece between said fixed stop and said workpiece rest, the step of:

unblocking said first piston with said blocking means.

4. A device for centering and clamping workpieces of varying axial thicknesses to be lapped by an expansion lap, comprising:

a fluid cylinder;

a first piston mounted in said fluid cylinder, said first piston having a first stroke including a first advanced position, a first retracted position and an intermediate position;

first advancing means, in communication with said first piston, for advancing said first piston;

a second piston concentrically mounted in said first piston, said second piston having a second stroke including a second advanced position and a second retracted position, said second stroke being substantially shorter than said first stroke;

second advancing means, in communication with said second piston, for advancing said second piston;

a fixed stop;

a workpiece rest for supporting a workpiece and positioned between said workpiece and said second cylinder, anti-rotation means in contact with said fixed stop for preventing angular movement of the workpiece; and means for controlling said first advancing means and said second advancing means, wherein, said device can be in a clamped position, a centering position and a rest position, wherein, when said device is in said clamped position, the workpiece is clamped between said workpiece rest and said fixed stop when said first piston is in said intermediate position and said second piston is in said second advanced position, and when said device is in said centering position, said first piston is in said intermediate position and said second piston is in a position other than in said second advanced position, such that the workpiece is not clamped and is freely translatable while said anti-rotating means engages said workpiece and prevents angular movement thereof, whereby said workpiece is centered relative to the expansion lap, and when said device is in said rested position, said first piston and said second piston are in said retracted positions.

5. A device for centering and clamping workpieces of varying axial thicknesses to be lapped by an expansion lap as defined in claim 4, further comprising:

retraction means, in communication with said first and said second pistons, for retracting said first and said second pistons; and blocking means for supporting said first piston when said retracting means is retracting said second piston into said position other than said second advanced position, wherein, said controlling means also controls said blocking means.

6. A device for centering and clamping workpieces of varying axial thicknesses to be lapped by an expansion lap as defined in claim 5, wherein said blocking means includes a fluid chuck.

7. A device for centering and clamping workpieces of varying axial thicknesses to be lapped by an expansion lap as defined in claim 6, wherein:

said workpiece is a gear having a plurality of teeth, and said anti-rotation means is a fixed element interacting with said plurality of teeth.

* * * * *